US012145030B2

(12) United States Patent
Kalfa

(10) Patent No.: US 12,145,030 B2
(45) Date of Patent: Nov. 19, 2024

(54) TELESCOPIC BALL RETRIEVAL DEVICE

(71) Applicant: Slinger Bag Ltd., Ra'anana (IL)

(72) Inventor: Yonah Kalfa, Ra'anana (IL)

(73) Assignee: Slinger Bag Ltd., Ra'anana (IL)

( * ) Notice: Subject to any disclaimer, the term of this patent is extended or adjusted under 35 U.S.C. 154(b) by 667 days.

(21) Appl. No.: 17/424,872

(22) PCT Filed: Jan. 22, 2020

(86) PCT No.: PCT/IL2020/050087
§ 371 (c)(1),
(2) Date: Jul. 21, 2021

(87) PCT Pub. No.: WO2020/157744
PCT Pub. Date: Aug. 6, 2020

(65) Prior Publication Data

US 2022/0118319 A1 Apr. 21, 2022

(30) Foreign Application Priority Data

Jan. 31, 2019 (IL) ..... 264585

(51) Int. Cl.
*A63B 47/02* (2006.01)
*A63B 47/00* (2006.01)
*A63B 102/02* (2015.01)

(52) U.S. Cl.
CPC ..... *A63B 47/02* (2013.01); *A63B 47/002* (2013.01); *A63B 2102/02* (2015.10); *A63B 2210/58* (2013.01); *A63B 2225/093* (2013.01)

(58) Field of Classification Search
CPC ... A63B 47/02; A63B 47/002; A63B 2102/02; A63B 2210/58; A63B 2225/093; A63B 71/0036
See application file for complete search history.

(56) References Cited

U.S. PATENT DOCUMENTS 2,962,321 A 11/1960 Willaim et al.
4,522,438 A * 6/1985 Logue ..... A63B 47/02 294/19.2

(Continued)

FOREIGN PATENT DOCUMENTS

| | | |
|---|---|---|
| CN | 206103241 U | 4/2017 |
| DE | 202017103854 | 7/2017 |
| WO | WO2016/042347 | 3/2016 |

OTHER PUBLICATIONS

Office Action for Chinese Patent Application No. 202080011041.4, mailed Jan. 9, 2022.

(Continued)

*Primary Examiner* — Stephen A Vu
(74) *Attorney, Agent, or Firm* — Klarquist Sparkman, LLP

(57) ABSTRACT

A ball retrieval device; comprises: a) a telescopic tubing assembly suitable to house a plurality of balls; b) a retrieval mechanism suitable to allow the passage of a ball into said tubing assembly and to prevent its discharge therefrom; c) a positioning element suitable to cooperate with slotted connecting elements and to prevent the undesired rotation of parts of said telescopic tubing assembly relatively to one another; and d) capping element provided with stopping elements, suitable to release balls from the device when said stopping elements are in an open position.

20 Claims, 3 Drawing Sheets

(56) References Cited

U.S. PATENT DOCUMENTS

| | | | | |
|---|---|---|---|---|
| 4,629,235 | A * | 12/1986 | Logue | A63B 47/02 294/19.2 |
| 5,292,161 | A | 3/1994 | Green | |
| 7,922,608 | B1 | 4/2011 | Shoham | |
| 2002/0141812 | A1 | 10/2002 | Edelen et al. | |
| 2002/0151390 | A1 | 10/2002 | Niksich | |
| 2004/0227365 | A1 * | 11/2004 | Hellerson | A63B 47/02 294/19.2 |
| 2014/0138967 | A1 * | 5/2014 | Miller | A63B 57/00 294/19.2 |
| 2015/0273283 | A1 * | 10/2015 | Davis | A63B 47/02 294/19.2 |

OTHER PUBLICATIONS

International Search Report and Written Opinion for PCT/IL2020/050087, mailed Apr. 6, 2020.

* cited by examiner

TELESCOPIC BALL RETRIEVAL DEVICE

CROSS REFERENCE TO RELATED APPLICATIONS

This is the U.S. National Stage of International Application No. PCT/IL2020/050087, filed Jan. 22, 2020, which was published in English under PCT Article 21(2), which in turn claims the benefit of Israeli Application No. 264585, filed on Jan. 31, 2019, which are all incorporated herein by reference.

FIELD OF THE INVENTION

The present invention relates to the field of sport accessories. More particularly, the present invention relates to a retrieval device for balls, particularly for games.

BACKGROUND OF THE INVENTION

When playing games that involve the use of balls, users sometimes need to pick up the balls during or after a game, and it can be burdening and tiring. Thus there is a need for a ball retrieval device that will provide an easy and comfortable solution. There are some retrieval devices, but they do not meet the combination of requirements for a height-adjustable retrieval device that allows an easy gathering of balls, which can house a plurality of balls and prevent them from rolling out of the device, until the user enables it by a simple mechanism.

It is an object of the present invention to provide a device that allows for an easy and convenient gathering of balls from a surface.

It is another object of the invention to provide a telescopic device the height of which can be adapted to the user's preference.

It is yet another object of the invention to provide a device that may house a different number of balls according to its height resulting from its telescopic positioning.

It is a further object of the invention to provide a device adapted to stop balls from being discharged after their retrieval, and to allow their discharge easily and at will. Other objects and advantages of the invention will become apparent as the description proceeds.

SUMMARY OF THE INVENTION

The invention relates to a ball retrieval device, which comprises: a telescopic tubing assembly suitable to house a plurality of balls; a retrieval mechanism suitable to allow the passage of a ball into said tubing assembly and to prevent its discharge therefrom; a positioning element suitable to cooperate with slotted connecting elements and to prevent the undesired rotation of parts of said telescopic tubing assembly relatively to one another; and a capping element provided with stopping elements, suitable to release balls from the device when said stopping elements are in an open position.

According to one embodiment of the invention, the positioning element is a pin that is located at one part of the device, suitable to slide along rails that are located at another part of the device. The relative movement of the pin along the rail that is located at a different part of the device, form a telescopic movement of the device, allowing length adjustment. This telescopic tubing assembly also comprises intermediate connecting elements suitable to connect two sections having different diameters. Each connecting element is suitable to connect to a different tube with a different diameter, and they are also suitable to connect to one another.

The stopping elements that are provided in the capping elements comprise, according to one embodiment of the invention, elastic snapping strips. The strips can bent and move from an open position to a closed position, wherein an open position is a position that allows the passage of balls, and a closed position prevents balls from passing. The capping elements can also comprise axes that hold the strips and provide them with a rotational movement in order to move from one position to the other.

The retrieval mechanism, according to one embodiment of the invention, comprises inner retrieval components suitable to allow the entrance of balls through one of the openings of the device, and prevent them from passing the other way around.

According to another embodiment of the invention, the inner retrieval components are shaped as teeth, and they are coupled to springs and provided with an axis at one end, suitable to allow said teeth to rotate. According to this embodiment, when pressure is applies at the edge of the teeth that is closer to the axis, the teeth press the spring and fold toward it, but when pressure is applied the other way around, the structure of the teeth and the location of the axis prevent them from moving. This way balls can pass through the retrieval mechanism only in one direction. According to another embodiment of the invention, the inner retrieval components are elastic, suitable to be displaced upon pressure, thus allowing the passage of balls through them when a user applies pressure during the retrieval activity.

DETAILED DESCRIPTION OF THE INVENTION

The present invention provides a device for ball retrieval. Although the description refers mostly to a retrieval device for tennis balls, the device is obviously suitable for other types of balls, such as ping-ping or golf balls. In addition, the drawings do not show balls, since when reading the description it is obvious to any person, especially a person skilled in the art, how to apply the device to any type of balls.

Figures 1A, 1B:
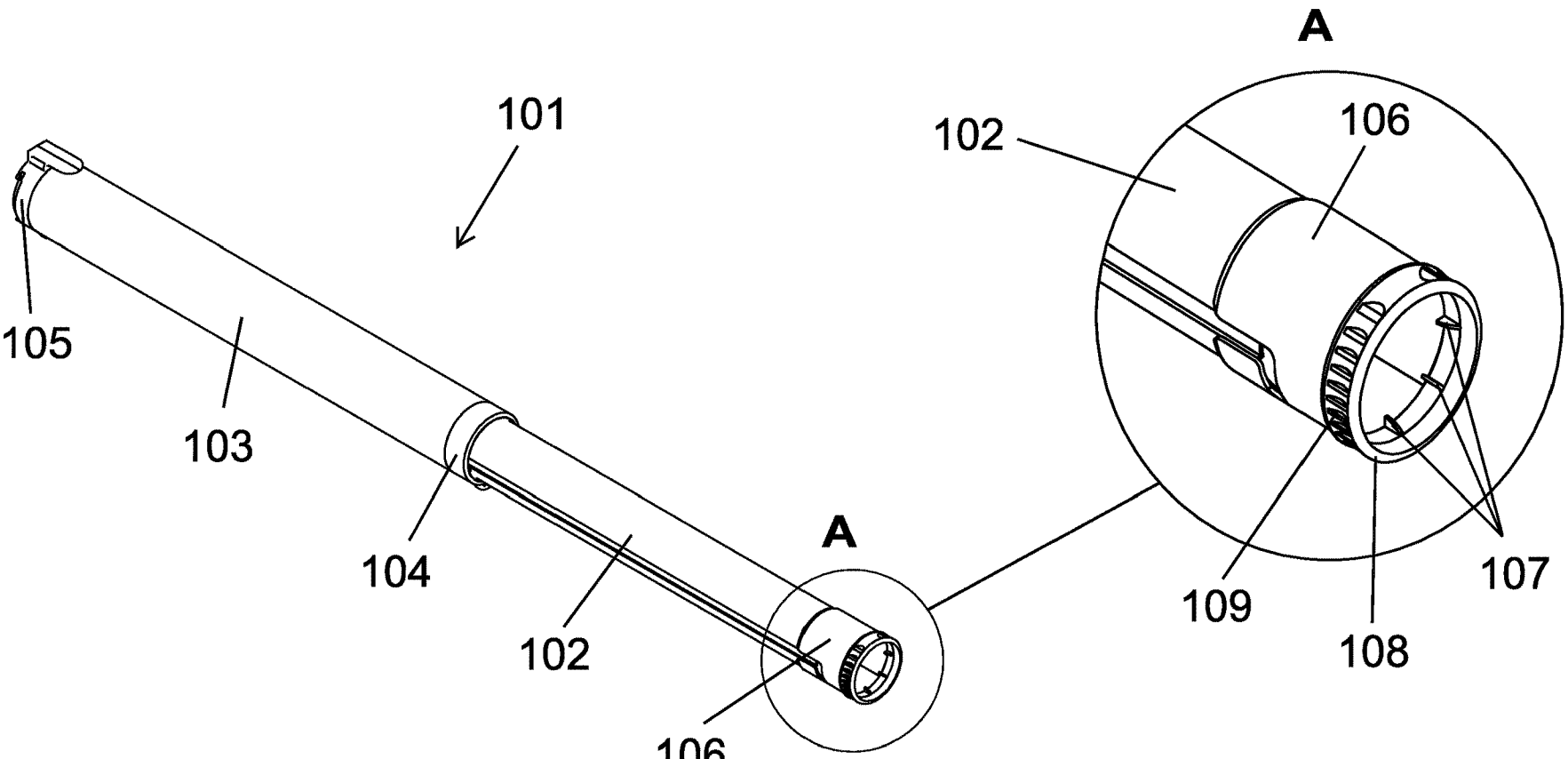
FIG. 1A is a perspective view of the device, according to one embodiment of the invention.
FIG. 1B is an enlarged view of a portion of FIG. 1A.

FIG. 1A shows a device, according to one embodiment of the invention, wherein the ball retrieval device 101 comprises inner tube 102, outer tube 103, first connecting element 104, first cap 105, and second cap 106. Inner tube 102 is suitable to host balls, and the inner diameter of inner tube 102 is essentially the size of the ball diameter, depending on the ball type that device 101 is designed to retrieve. If, for example, device 101 is designed to retrieve tennis balls, then the diameter of inner tube 102 will be essentially the size of a tennis ball diameter with a tolerance needed for the ball to access the tube.

FIG. 1B is an enlarged view of section A of FIG. 1A, showing second cap 106 and a portion of inner tube 102. As shown in FIG. 1B, cap 106 comprises inner teeth 107, which may be static for use with resilient balls, or may be spring-operated teeth that allow the entrance of balls through the opening 108 of cap 106 but return to their original position after the entrance of the ball to impede its exit. Alternatively, the teeth may be foldable around an axis. In this case, the axis of each one of teeth 107 is located at the edge of the tooth that is closer to opening 108 of cap 106, and when a ball enters tube 102 through opening 108, teeth 107 fold into suitable depressions (not shown in the figures) in cap 106 and allow the passage of balls through opening 108 of cap 106 and into tube 102.

As described, teeth 107 can move in some embodiments, but only when pressure is applied on them from the entrance and toward inner tube 102. The edges of teeth 107 that are more distant from opening 108 are designed to prevent the exit of balls from tube 102. The arrangement of teeth 107 side by side along the inner circumference of cap 106 form a blocking structure for the balls that are housed inside tube 102, since the diameter of said blocking structure is smaller than the diameter of the balls. Of course, teeth 107 can be replaced with any other structure that provides the ability to insert balls through opening 108 and prevent them from passing the other way around, and the invention is not limited to any specific structure. For instance, elastic elements can be provided in the circumference of cap 106, which are displaced upon pressure and may have any desired shape.

The insertion of balls through opening 108 into tube 102 can be performed, for example, by placing device 101 on top of a ball and applying pressure downward. This way the ball applies pressure on teeth 107, passing them, allowing them to enter inner tube 102. This way of operation is very comfortable for a user, since he can retrieve balls without bending.

As also shown in FIG. 1B, cap 106 comprises supporting ribs 109, which are suitable to impart strength to cap 106, especially when pressure is applied during the insertion of balls. Ribs 109 are only an exemplary solution for providing structural support, but of course cap 106 can comprise any other means, suitable to provide sufficient structural strength.

Back to FIG. 1A, ball retrieval device 101 is a telescopic device, comprising inner tube 102 and outer tube 103, which together form a telescopic mechanism. The inner diameter of outer tube 103 is essentially the same or slightly larger than the outer diameter of inner tube 102, allowing inner tube 102 to be inserted into and to slide along outer tube 103. The telescopic mechanism will be described in detail as the description proceeds.

Figure 2:
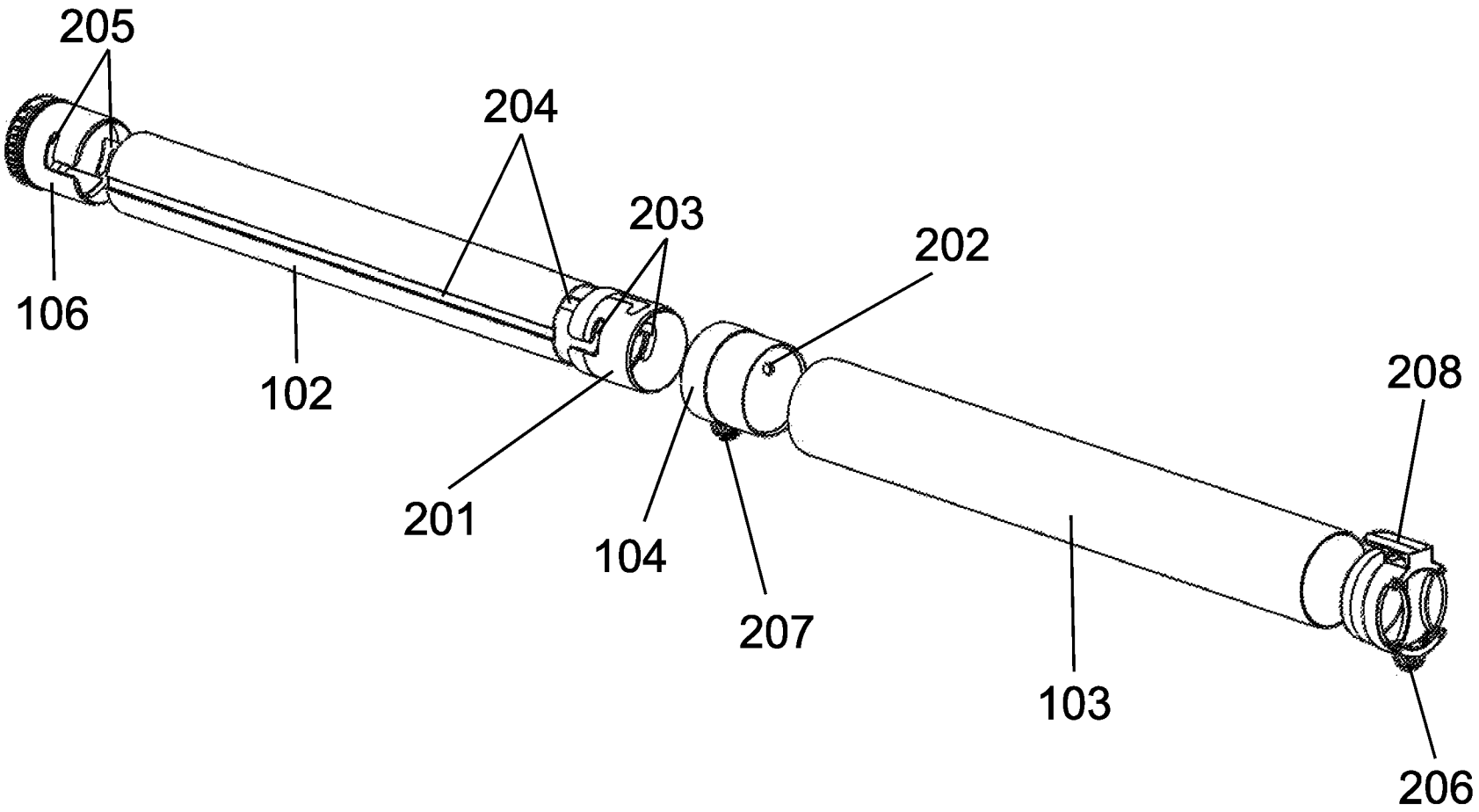
FIG. 2 is an exploded view of the device of FIG. 1A.

FIG. 2 is an exploded view of device 101 of FIG. 1A, showing the different components of device 101 apart from each other. First connecting element 104, which was also partly shown in FIG. 1A, is suitable to be connected to second connecting element 201. Connecting elements 104 and 201 are also suitable to be respectively connected to tubes 103 and 102. First connecting element 104 comprises a positioning element, in the specific embodiment of FIG. 2, in the form of pin 202, suitable to cooperate with second connecting element 201, which comprises slots 203. The positioning element allows for the telescopic operation of the device, and is further useful to prevent undesired rotation of tubes 103 and 102 relatively to one another. As will be appreciated by the skilled person, this positioning arrangement is only one of the many that can be devised, and the operations allowed by pin 202 can be performed using more than one separate element. The invention is not limited to any specific positioning element. When first connecting element 104 and second connecting element 201 are connected to each other, pin 202 is located inside element 104, and is pressured during assembly to move inside one of slots 203.

Tube 102 comprises depressed rails 204, also suitable to host pin 202, as slots 203. Rails 204 are aligned with slots 203, and when pin 202 is located inside one of slots 203, it can slide into and along one of rails 204, thus providing a telescopic mechanism: outer tube 103 is connected to element 104 that comprises pin 202. Inner tube 102 comprises rails 204 and is connected to element 201 that comprises slots 203. When connecting elements 104 and 201 and positioning pin 202 inside one of slots 203, in order to operate the telescopic mechanism, one needs to slide pin 202 along rails 204, causing tube 102 to slide inside tube 103.

FIG. 2 shows only one pin 202 and two slots 203, but of course device 101 can comprise any number of pins and slots, suitable to provide a telescopic structure that can withstand the mechanical loads, and in the embodiment of the figures it comprises two pins 202 (one of them not seen in the figures) that cooperate with two rails 204 and slots 203.

Second cap 106 comprises additional slots 205, similar to slots 203. The shape of slots 203 and 205 is a corner shape, which provides a locking mechanism. When pin 202 is inserted into the non-longitudinal part of slots 203 and 205, pin 202 is prevented from moving along the longitude axis of device 101, and tube 102 and 103 can no longer move in relation to one another. This state is also referred to as a locked position. When pin 202 is located inside one of slots 203 in a locked position, the device is in its most elongated state, and when pin 202 is located inside one of slots 205 in a locked position, the device is in its shortest state. The device can further comprise additional slots along tube 102, or other locking mechanisms, to provide additional locked positions when tubes 102 and 103 are partially overlapping.

The telescopic mechanism of device 101 and the possibility to lock device 101 at different overall lengths provides a significant advantage, since a user can adjust device 101 according to the number of balls and according to his height. In addition, the ball retrieval mechanism of device 101 provides an easy and comfortable retrieving operation, without the need to bend or make a substantial physical effort.

FIG. 2 also shows that device 101 comprises hooks 206 and 207, wherein hook 206 is connected to first cap 105 and hook 207 is connected to first connecting element 104. Hooks 206 and 207 are suitable to provide the ability to hang device 101. Hooks 206 and 207 are also suitable to hold a strap, which allows a user to comfortably carry device 101. Cap 105 also comprises latch 208, providing a user the ability to hang device 101, for example, on a belt.

Figure 3B:
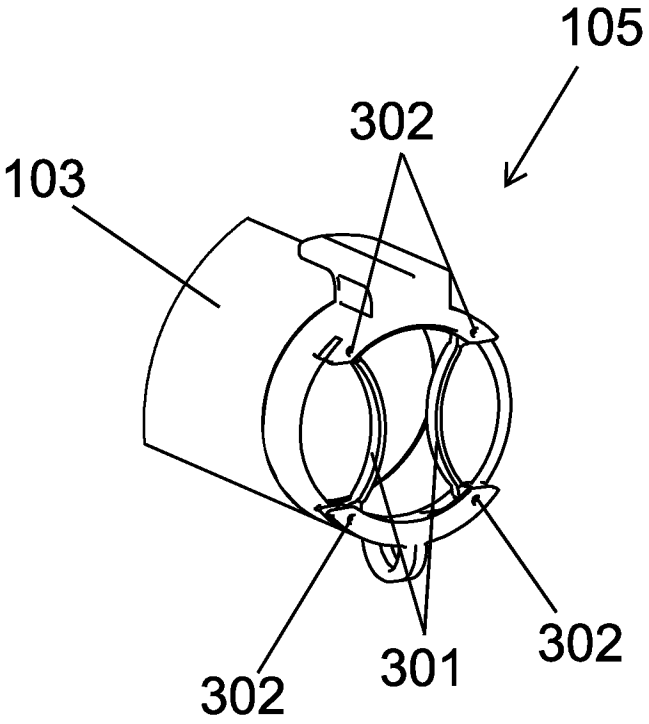
FIG. 3B is a perspective view of the cap of FIG. 3A, wherein the strips are in a closed position.
Figure 3A:
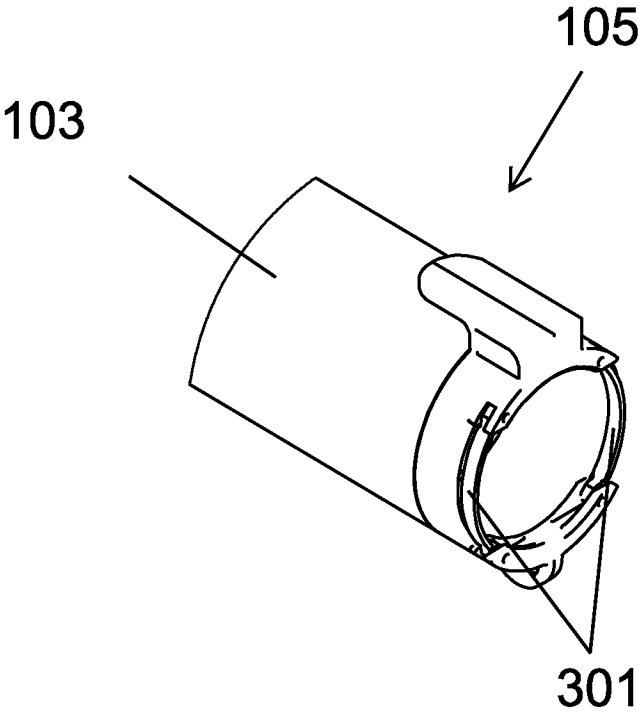
FIG. 3A is a perspective view of the first cap of the device of FIG. 101, wherein the strips of said cap are in an open position.

In addition to the telescopic mechanism and the retrieval mechanism, device 101 also comprises a locking mechanism. FIG. 3A shows cap 105, which also comprises strips 301. In this figure, strips 301 are in an open position, meaning that strips 301 do not cross the perimeter of the inner surface of cap 105. In this open position, balls that are located inside tube 103 (shown in FIGS. 1A and 2) can pass through cap 105 and leave device 101. FIG. 3B shows cap 105, wherein strips 301 are in a closed position, meaning that strips 301 are in a position that prevents balls from passing through cap 105. The shape and material of strips 301 are designed to allow them to be bent and moved from one position to another, and cap 105 can also comprise axes, located at points 302, which contribute to the movement of strips 301.

The above description of specific embodiments has been provided for the purpose of illustration and is not intended to limit the invention in any way. Many modification and variations can be effected in the device, without exceeding the scope of the invention.

The invention claimed is:

1. A ball retrieval device, comprising:

a) a telescopic tubing assembly suitable to house a plurality of balls, wherein the telescopic tubing assembly comprises intermediate slotted connecting elements suitable to connect two parts of said tubing assembly having different diameters;

b) a retrieval mechanism suitable to allow passage of a ball into said tubing assembly and to prevent its discharge therefrom;

c) a positioning element suitable to cooperate with the slotted connecting elements and to prevent undesired rotation of the two parts of said telescopic tubing assembly relative to one another; and d) a capping element provided with stopping elements, suitable to release the balls from the device when said stopping elements are in an open position.

2. The device according to claim 1, wherein the positioning element comprises a pin.

3. The device according to claim 1, wherein the stopping elements provided in the capping elements comprise elastic snapping strips.

4. The device according to claim 1, wherein the tubing assembly has a plurality of openings, and wherein the retrieval mechanism comprises inner retrieval components suitable to allow entrance of the balls through one of the openings of the tubing assembly, and prevent the balls from passing the other way around.

5. The device according to claim 4, wherein the inner retrieval components are teeth-shaped components.

6. The device according to claim 4, wherein the inner retrieval components are elastic, suitable to be displaced upon pressure.

7. The device according to claim 1, wherein at least one of the two parts of the tubing assembly is formed with one or more longitudinally extending rails with which the positioning element cooperates in order to customize a length of the tubing assembly, and wherein at least one of the two parts is configured with a slot aligned with at least one of said rails and having a portion that is non-longitudinally extending to provide a locked position for the positioning element.

8. The device according to claim 7, wherein the at least one part of the tubing assembly that is formed with the one or more longitudinally extending rails is also formed with at least one additional slot between the two parts which is aligned with one of the rails and configured with the non-longitudinally extending portion, to provide an additional locked position when the two parts are partially overlapping.

9. The device according to claim 8, wherein the slot aligned with at least one of the rails that includes the non-longitudinally extending portion is configured as a corner.

10. A ball retrieval device comprising:

a) a telescopic tubing assembly having a plurality of openings and suitable to house a plurality of balls;

b) a retrieval mechanism suitable to allow passage of a ball into said tubing assembly and to prevent its discharge therefrom, wherein the retrieval mechanism comprises teeth-shaped inner retrieval components suitable to allow entrance of the balls through one of the openings of the tubing assembly, and prevent them from passing the other way around, and wherein the teeth-shaped components are coupled to springs and are provided with an axis at one end, suitable to allow said teeth to rotate;

c) a positioning element suitable to cooperate with slotted connecting elements of the tubing assembly and to prevent undesired rotation of parts of said telescopic tubing assembly relative to one another; and d) a capping element provided with stopping elements, suitable to release the balls from the device when said stopping elements are in an open position.

11. The device according to claim 7, wherein the telescopic tubing assembly comprises intermediate connecting elements suitable to connect the two parts of the tubing assembly having different diameters.

12. The device according to claim 10, wherein the positioning element comprises a pin.

13. The device according to claim 10, wherein the stopping elements provided in the capping elements comprise elastic snapping strips.

14. The device according to claim 10, wherein at least one of the two parts of the tubing assembly is formed with one or more longitudinally extending rails with which the positioning element cooperates in order to customize a length of the tubing assembly, and wherein at least one of the two parts is configured with a slot aligned with at least one of said rails and having a portion that is non-longitudinally extending to provide a locked position for the positioning element.

15. A ball retrieval device, comprising:

a telescopic tubing assembly suitable to house a plurality of balls;

a retrieval mechanism suitable to allow passage of a ball into said tubing assembly and to prevent its discharge therefrom;

a positioning element suitable to cooperate with slotted connecting elements of said tubing assembly and to prevent undesired rotation of parts of said telescopic tubing assembly relative to one another; and a capping element provided with stopping elements, suitable to release the balls from the device when said stopping elements are in an open position, wherein the stopping elements provided in the capping elements comprise elastic snapping strips.

16. The device according to claim 15, wherein the positioning element comprises a pin.

17. The device according to claim 15, wherein the telescopic tubing assembly comprises intermediate connecting elements suitable to connect two of the parts of the tubing assembly having different diameters.

18. The device according to claim 15, wherein the tubing assembly has a plurality of openings, and wherein the retrieval mechanism comprises inner retrieval components suitable to allow entrance of the balls through one of the openings of the tubing assembly, and prevent them from passing the other way around.

19. The device according to claim 18, wherein the inner retrieval components are teeth-shaped components.

20. The device according to claim 15, wherein at least one of the two parts of the tubing assembly is formed with one or more longitudinally extending rails with which the positioning element cooperates in order to customize a length of the tubing assembly, and wherein at least one of the two parts is configured with a slot aligned with at least one of said rails and having a portion that is non-longitudinally extending to provide a locked position for the positioning element.

* * * * *